US008303053B2

(12) United States Patent
Bond et al.

(10) Patent No.: US 8,303,053 B2
(45) **Date of Patent: *Nov. 6, 2012**

(54) SHELF EXTENDING AND LIFTING SYSTEM

(75) Inventors: Steve Bond, Agoura, CA (US); Andrew Tiffin, Thousand Oaks, CA (US)

(73) Assignee: Easy Lift, LLC, Thousand Oaks, CA (US)

( * ) Notice: Subject to any disclaimer, the term of this patent is extended or adjusted under 35 U.S.C. 154(b) by 473 days.

This patent is subject to a terminal disclaimer.

(21) Appl. No.: 12/579,191

(22) Filed: Oct. 14, 2009

(65) Prior Publication Data

US 2010/0045152 A1 Feb. 25, 2010

Related U.S. Application Data

(63) Continuation-in-part of application No. 11/584,299, filed on Oct. 19, 2006, now Pat. No. 7,621,605, which is a continuation-in-part of application No. 10/956,962, filed on Sep. 30, 2004, now abandoned.

(51) Int. Cl.
*A47B 95/00* (2006.01)

(52) U.S. Cl. ..... 312/319.2; 312/319.5

(58) Field of Classification Search ..... 312/294, 312/309–311, 228.1, 228, 319.1–319.8, 325, 312/334.2, 410, 330.1, 327, 328; 211/126.15, 211/41.4, 41.8; 134/135, 133, 56 D, 58 D, 134/57 D, 199, 200; 474/4, 84, 148; 254/389, 254/393, 394; 74/89.2, 89.22
See application file for complete search history.

(56) References Cited

U.S. PATENT DOCUMENTS

| | | | | |
|---|---|---|---|---|
| 1,283,513 | A | | 11/1918 | Heyward |
| 2,473,239 | A | * | 6/1949 | Boyd ..... 312/319.3 |
| 2,590,341 | A | | 3/1952 | Nabholz |
| 2,919,966 | A | | 1/1960 | Preston |
| 3,195,969 | A | | 7/1965 | Wallen |
| 3,799,640 | A | * | 3/1974 | Jacobs ..... 312/273 |
| 4,076,351 | A | * | 2/1978 | Wyant ..... 312/247 |
| 4,095,422 | A | | 6/1978 | Kurakake |
| 4,281,557 | A | * | 8/1981 | Ohta et al. ..... 74/89.22 |
| 4,893,885 | A | | 1/1990 | Borello |
| 4,915,461 | A | | 4/1990 | Kingsborough et al. |
| 5,228,763 | A | * | 7/1993 | Gingold ..... 312/266 |
| 5,249,858 | A | | 10/1993 | Nusser |
| 5,308,158 | A | | 5/1994 | Vogelgesang et al. |
| 5,595,200 | A | | 1/1997 | Favaro |
| 5,996,723 | A | | 12/1999 | Shimizu et al. |

(Continued)

FOREIGN PATENT DOCUMENTS

JP 2000000201 * 1/2000

*Primary Examiner* — Janet M Wilkens

(57) ABSTRACT

A basket apparatus includes a basket positioned in a cabinet, a motor to drive the basket from a rearward lowered position in the cabinet to a forward directed raised position outside of the cabinet and a driver connecting the basket to the motor. In one embodiment, the driver has an extendable drive portion to allow manual movement of the basket from the rearward lowered position to a forward lowered position and a rigid drive portion to transmit force from the motor to the basket to drive the basket between the rearward lowered position and the forward directed raised position so that the basket may be pulled by a user from a rearward lowered position to a forward lowered portion and the driver enables the motor to drive the basket to the forward directed raised position outside of the cabinet.

10 Claims, 13 Drawing Sheets

U.S. PATENT DOCUMENTS

| | | | |
|---|---|---|---|
| 6,073,624 | A | 6/2000 | Laurent |
| 6,247,771 | B1 | 6/2001 | Miller |
| 6,510,858 | B1 | 1/2003 | Halstead et al. |
| 6,755,490 | B2 | 6/2004 | Welch et al. |
| 6,991,199 | B2 | 1/2006 | Carpentier |
| 7,410,228 | B2 | 8/2008 | Dickson et al. |
| 2004/0163687 | A1 | 8/2004 | Son et al. |
| 2005/0206282 | A1 | 9/2005 | Walburn |
| 2008/0129168 | A1 | 6/2008 | Banta et al. |
| 2008/0272072 | A1 | 11/2008 | Tynes et al. |

* cited by examiner

SHELF EXTENDING AND LIFTING SYSTEM

CROSS-REFERENCE TO RELATED APPLICATIONS

This is a continuation-in-part application of U.S. patent application Ser. No. 11/584,299, filed Oct. 19, 2006 now U.S. Pat. No. 7,621,605 and which is a continuation-in-part of application Ser. No. 10/956,962, filed Sep. 30, 2004 now abandoned.

BACKGROUND OF THE INVENTION

1. Field of the Present Disclosure

This disclosure relates generally to dishwasher appliances and similar apparatuses and more particularly to such apparatuses with mechanized shelf-raising and lowering capability.

2. Description of Related Art Including Information Disclosed Under 37 CFR 1.97 and 1.98

Laurent, U.S. Pat. No. 6,073,624, A swing-out supporting arrangement primarily intended for a wall-mounted oven of domestic type comprises a bottom plate supported by link arms, said bottom plate and an insert, possibly associated with said bottom plate, being retractable from the oven by a swing-out movement without the use of any front door. The bottom plate with the insert can be moved between a first position inside the oven and a second swing-out position below and in front of the over front wall. Preferably, the swing-out movement is performed by means of an electric motor which is rotatable between two end positions. The principle of invention can also be used for a ceiling plate supported by link arms, said plate being swingingly displaced in a corresponding lifting movement from an oven positioned at a low level.

Vogelgesang et al, U.S. Pat. No. 5,308,158 describes a pull down shelf assembly for facilitating access to upper storage shelves. The shelf assembly includes a shelf guide track mechanism and the storage shelf slidably mounted for movement between an extended position and a retracted position. A pantographic pull down mounting assembly coupled between a shelf mounting bracket and the track mechanism produces pantographic movement thereof between a deployed position, for increased access, and an elevated stored position. The pantographic assembly is mounted therebetween at locations producing near-horizontal pantographic movement of the track mechanism with the storage shelf carried thereby throughout an arcuate path between the deployed position and the elevated stored position. A spring biasing mechanism coupled between the mounting bracket and one of the arms biases the track mechanism toward the stored position. A shelf locking mechanism, positioned between the track mechanism and the storage shelf, locks the storage shelf in the extended position during movement of the track mechanism from the deployed position to the elevated stored position.

Nusser, U.S. Pat. No. 5,249,858, discloses a motor driven movable cabinet that provides top shelf accessibility by being lowered outwardly onto the underlying counter top and retracted back to its original position against the wall. A motor driven threaded screw lifting mechanism powers the cabinet's movement and consists of a reversible electric motor and a drive shaft assembly, including a drive shaft and a threaded screw drive rod. The motor is attached to the drive shaft assembly by a universal joint and a load bearing bracket pivot assembly. This motorized mechanism is then fastened to a wall frame that is secured to the wall behind the cabinet. The cabinet is also attached to the wall frame by at least four L-shaped swing arms and to the motorized mechanism by a pivot mount bracket hingedly attached to the bottom of the cabinet. The pivot assembly supports the drive shaft assembly and the universal joint allows for a change in the angle from the pivot assembly along the drive shaft and threaded screw drive rod to the bottom of the cabinet. The actual raising and lowering operations result when the motor rotates the drive shaft causing the rod to shorten as it screws up into the shaft thereby raising the cabinet. The cabinet is lowered when the threaded screw rod lengthens by unscrewing from the drive shaft. At least four L-shaped swing arms assist the motored mechanism in moving the cabinet by maintaining the cabinet's parallel position to the wall.

Wallen, U.S. Pat. No. 3,195,969, discloses a dishwasher with front top opening, and movable supports for guiding movement of the support first vertically and then outwardly for access through the top opening.

Heyward, U.S. Pat. No. 1,283,513, discloses a typewriter desk with side flanges of a desk top slotted so that the desk top may by quickly and easily removed.

The related art described above discloses apparatuses with moving shelves, however, the prior art fails to disclose a means for moving a shelf linearly and then in an arc from a rearward lower position to an extended upper position using slots enabling the application of only horizontal forces, followed by lifting forces in a simplified apparatus. The present disclosure distinguishes over the prior art providing heretofore unknown advantages as described in the following summary.

SUMMARY OF THE INVENTION

A basket apparatus is disclosed that includes a basket positioned in a cabinet, a motor to drive the basket from a rearward lowered position in the cabinet to a forward directed raised position outside of the cabinet and a driver connecting the basket to the motor. In one embodiment, the driver has an extendable drive portion to allow manual movement of the basket from the rearward lowered position to a forward lowered position and a rigid drive portion to transmit force from the motor to the basket to drive the basket between the rearward lowered position and the forward directed raised position so that the basket may be pulled by a user from a rearward lowered position to a forward lowered portion and the driver enables the motor to drive the basket to the forward directed raised position outside of the cabinet.

A method is disclosed to enable manual operation of a motor-driven basket, the method including driving a basket from a forward lowered position to a rearward lowered position in a cabinet using rotational force from a motor that is rotating in a first rotational sense, the rotational force transmitted to the basket through a first cable, stepping back the motor to provide slack in the first cable to enable manual translation of the basket back to the forward lowered position, and taking up the slack using a first elastic member.

BRIEF DESCRIPTION OF THE DRAWINGS

The accompanying drawings illustrate at least one of the best mode embodiments of the present invention. In such drawings.

DETAILED DESCRIPTION OF THE INVENTION

Figure 1:
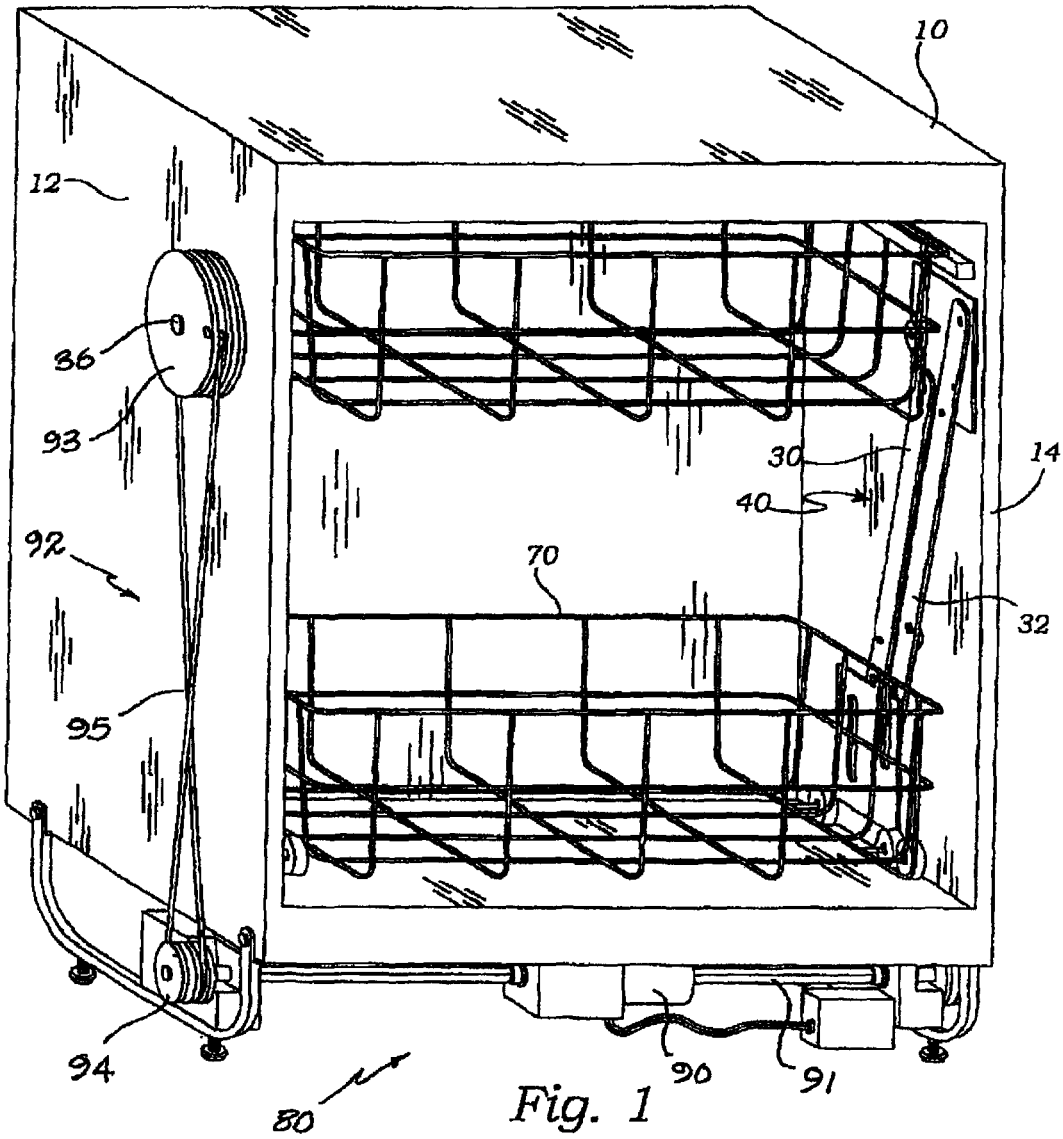
FIG. 1 is a perspective view of a preferred embodiment of the invention showing a basket of the invention in a retracted position.

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

The present invention includes a cabinet 10 housing a basket 70 such as is found in commercial dishwashers. The cabinet 10 has opposing side walls 12 and 14 as shown in the figures. Clearly, such a cabinet preferably also has a top, back and bottom panels, and a door 11 as shown. Numeral 20 in FIG. 8 identifies an open frontal area of cabinet 10. Two pairs of arms 30 and 32 are mounted within cabinet 10 one pair on each side of the cabinet 10. As shown in FIG. 3, a proximal end 34 of one of the arms 32 of each of the pairs of arms is engaged with a rotatable axle 36 which is supported by the opposing side walls 12 and 14, thereby enabling the arms 30 and 32 to rotate between a downward, rearwardly directed position 40 (FIGS. 1, 3 and 6) within the cabinet 10, and a forward, raised position 50 (FIGS. 5, 8 and 9), extensive of the open frontal area 20. Distal ends 35 of the arms 30 and 32 are pivotally engaged within elongate closed slots 62 and 64 in the basket 70; wherein the slots 62 and 64, and arms 30, 32 are arranged to move the basket 70 linearly between the rearward, lowered position shown in FIGS. 1 and 3, and a forward, lowered position shown in FIGS. 2 and 7 as the arms 30 and 32 traverse the elongate slots 62 and 64 respectively, and without raising the basket vertically. As the arms 30 and 32 continue in the forward direction, they raise the basket 70 vertically in arcuate rotation into the extended, raised position which is at least partially forward of the open frontal area 20. The arms 30, 32 move between the downwardly, rearwardly directed position 40 within the cabinet 10, and the forwardly directed, raised position 50 extensive of the open frontal area 20 to achieve the above described movement of basket 70. In order to accomplish the movement of arms 30, 32 as described above, an electric drive system 80 is employed, as will be described.

Figure 5:
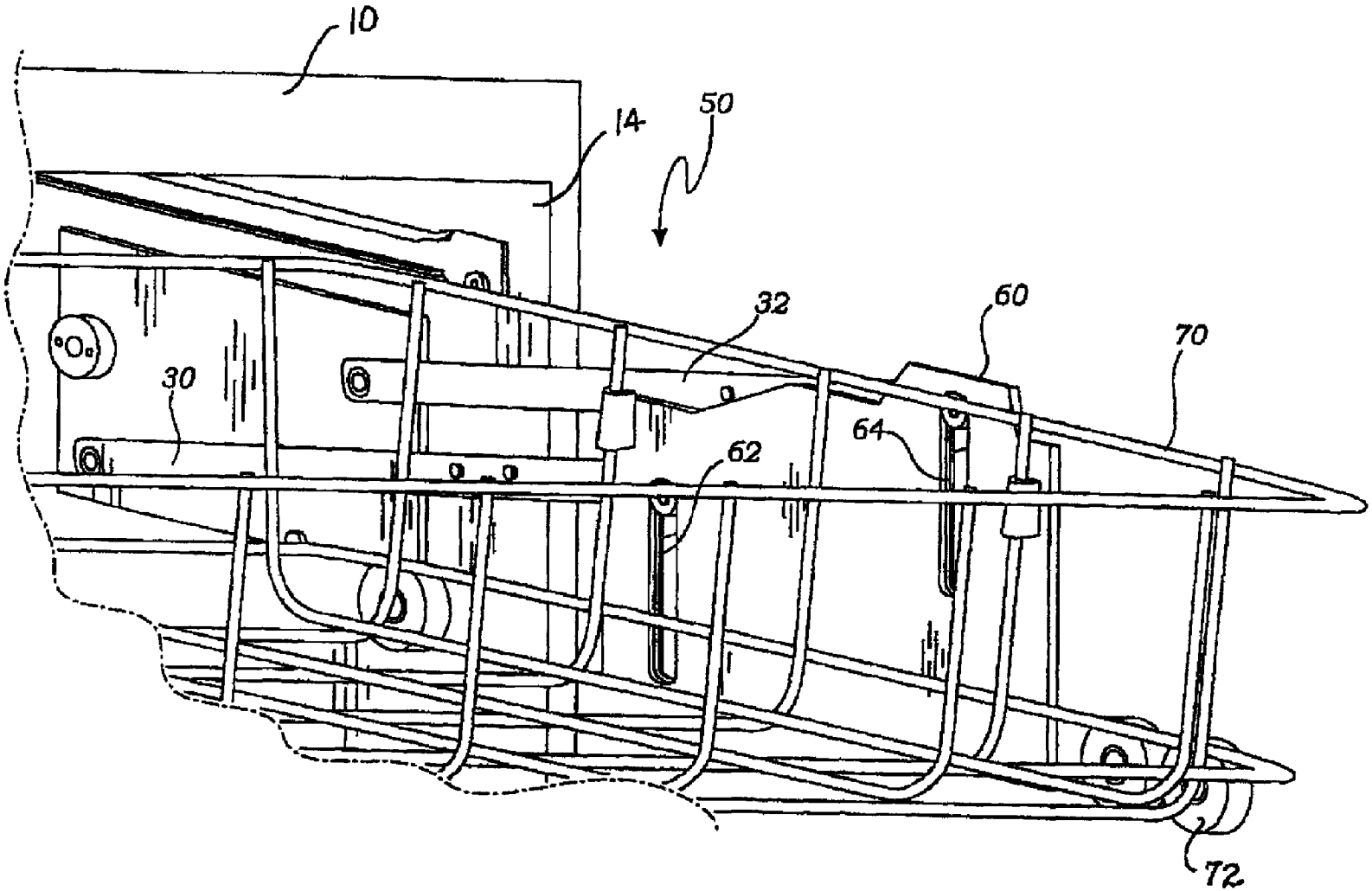
FIG. 5 is an partial enlarged perspective view thereof showing details of the lifting arms with the basket in the raised position.
Figure 6:
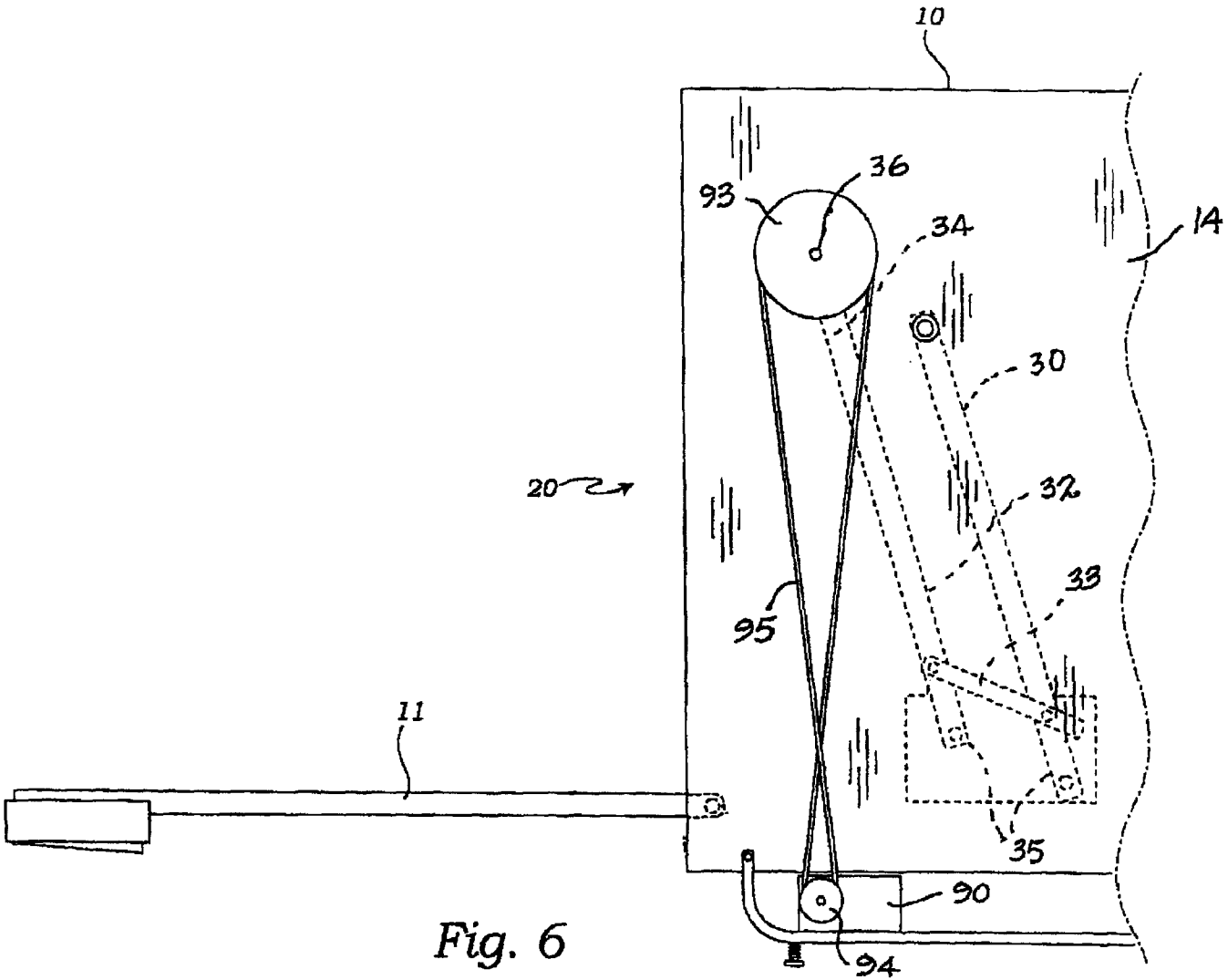
FIGS. 6-8 are side elevational views thereof showing a door of the apparatus in a folded down position and a pulley drive lifting mechanism of the invention with basket retracted, forward and raised respectively.
Figure 8:
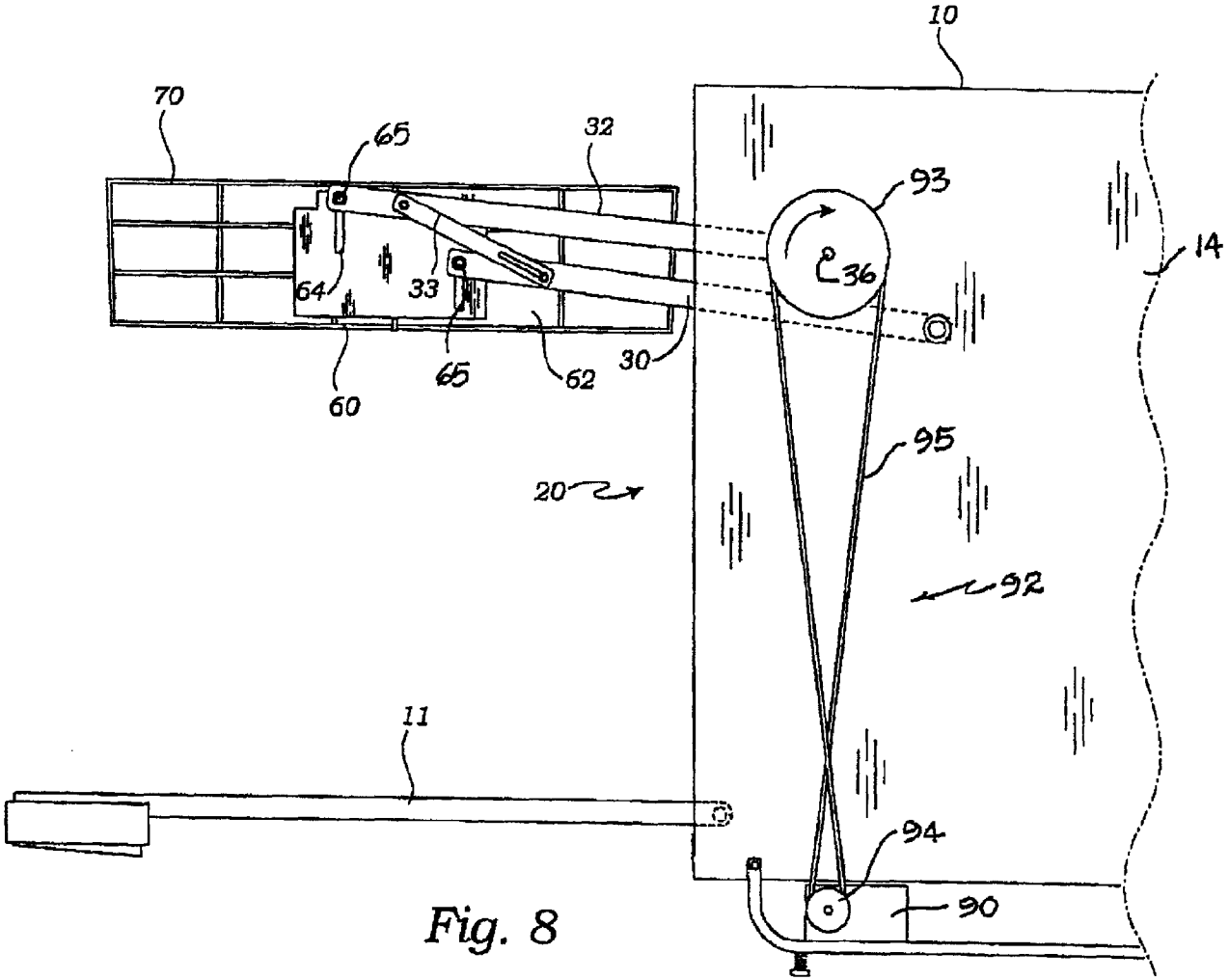

It is noted, that when the arms 30, 32 are moved to the raised position 50, as shown in FIGS. 5 and 8, the basket 70 is preferably raised to the level of a typical counter top so as to be in position for loading and unloading without having to stoop or bend over.

As shown then, basket 70 is able to move by rolling on wheels 72, between positions 40 and 45 by force exerted by arms 30 and 32. This linear horizontal motion of the basket 70 is accomplished without lifting forces because the distal ends 35 of arms 30 and 32 slide within closed slots 62 and 64 on wheels or glides 65.

The use of the term "basket" herein shall also include and refer to shelves, trays and other types of article holding or storing devices. While the term "basket" is commonly used to describe a shelf in a dishwasher apparatus, it is noted here that the invention is not limited to such apparatuses.

Figure 4:
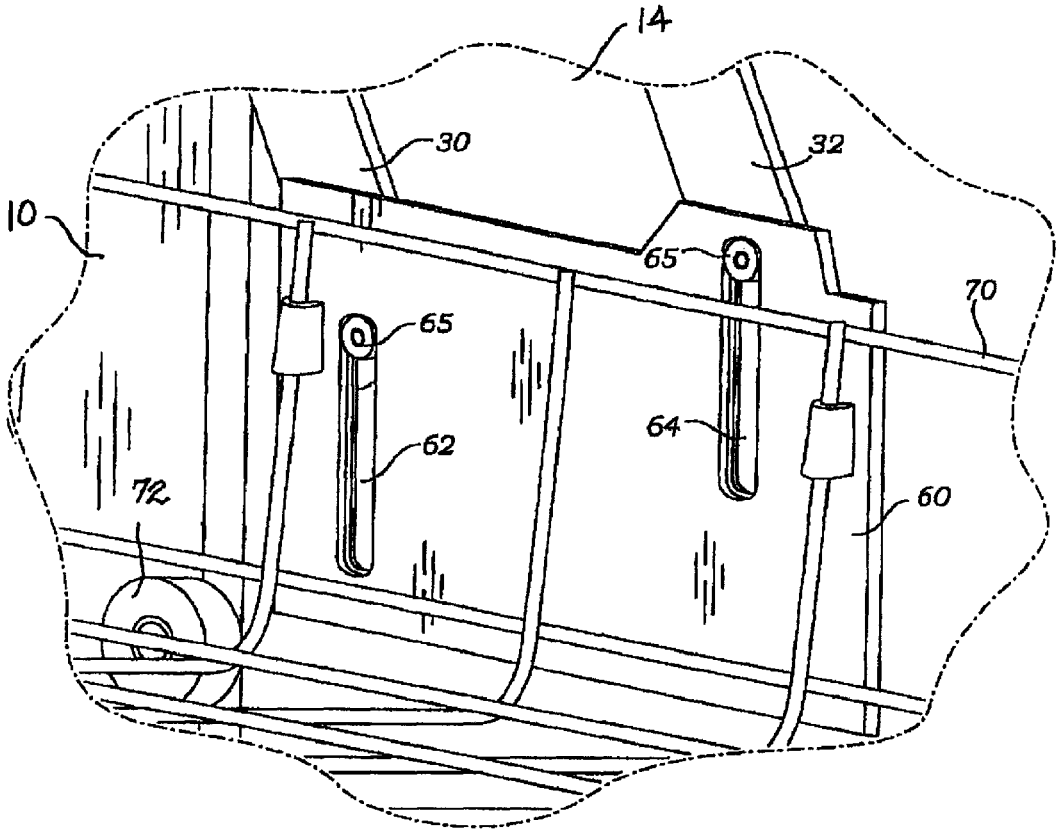
FIG. 4 is a partial enlarged view thereof showing details of a basket guide plate of the invention.

The arms 30 and 32 of each of the pairs of arms are preferably pivotally interconnected by a strut 33, the strut acting to stabilize the arms 30 and 32 and maintain them in parallel alignment, as they move over their course of motion. Preferably, guide plates 60 (part of basket 70) each provide the slots 62 and 64, whereby the arms 30 and 32, at their distal ends 35, are adapted for being captured for sliding motion in slots 62 and 64 respectively as best seen in FIG. 4. Such adaptation preferably includes rollers 65, as previously stated, which are able to move in the slots 62, 64 with near frictionless sliding and/or roller motion.

In a preferred embodiment, the electric drive system 80 comprises a motor 90 engaged with a drive pulley system 92 for rotating the axles 36 in first and second rotational senses, i.e., clockwise and counterclockwise rotation. The drive pulley system 92 preferably includes a pair of follower pulleys 93, wherein, each of the follower pulleys 93 is engaged with one of the axles 36. The drive pulley system 92 further includes a pair of drive pulleys 94, where, each of the drive pulleys 94 is engaged with the motor 90 by shaft 91. Each of the follower and drive pulleys 93 and 94 respectively, are joined by two flexible cables 95' and 95" for transmitting rotational force from the motor 90 to the axles 36 in their opposing rotational directions.

Figure 2:
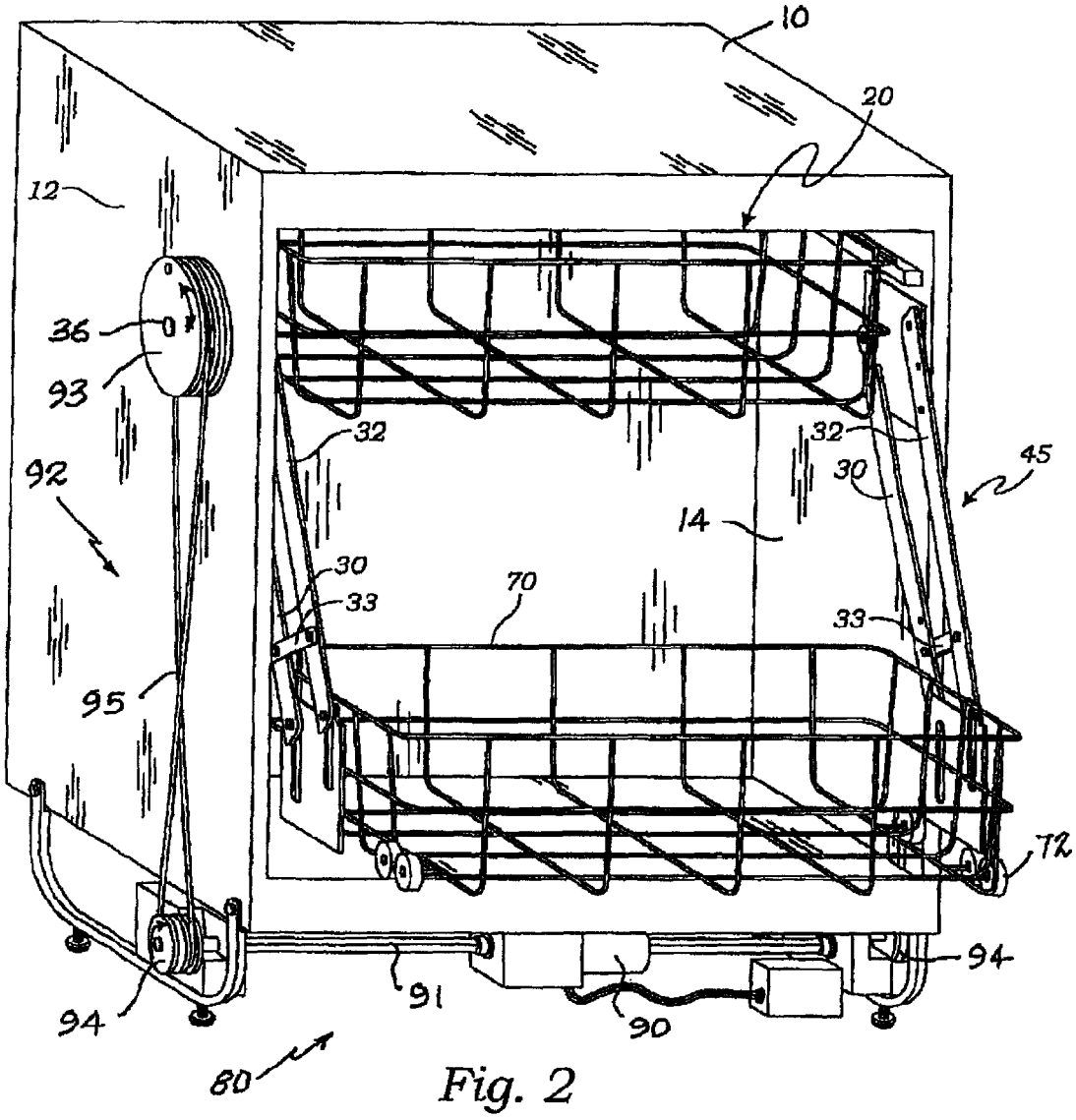
FIG. 2 is the same view as FIG. 1 but showing the basket in an extended lowered position.
Figure 3:
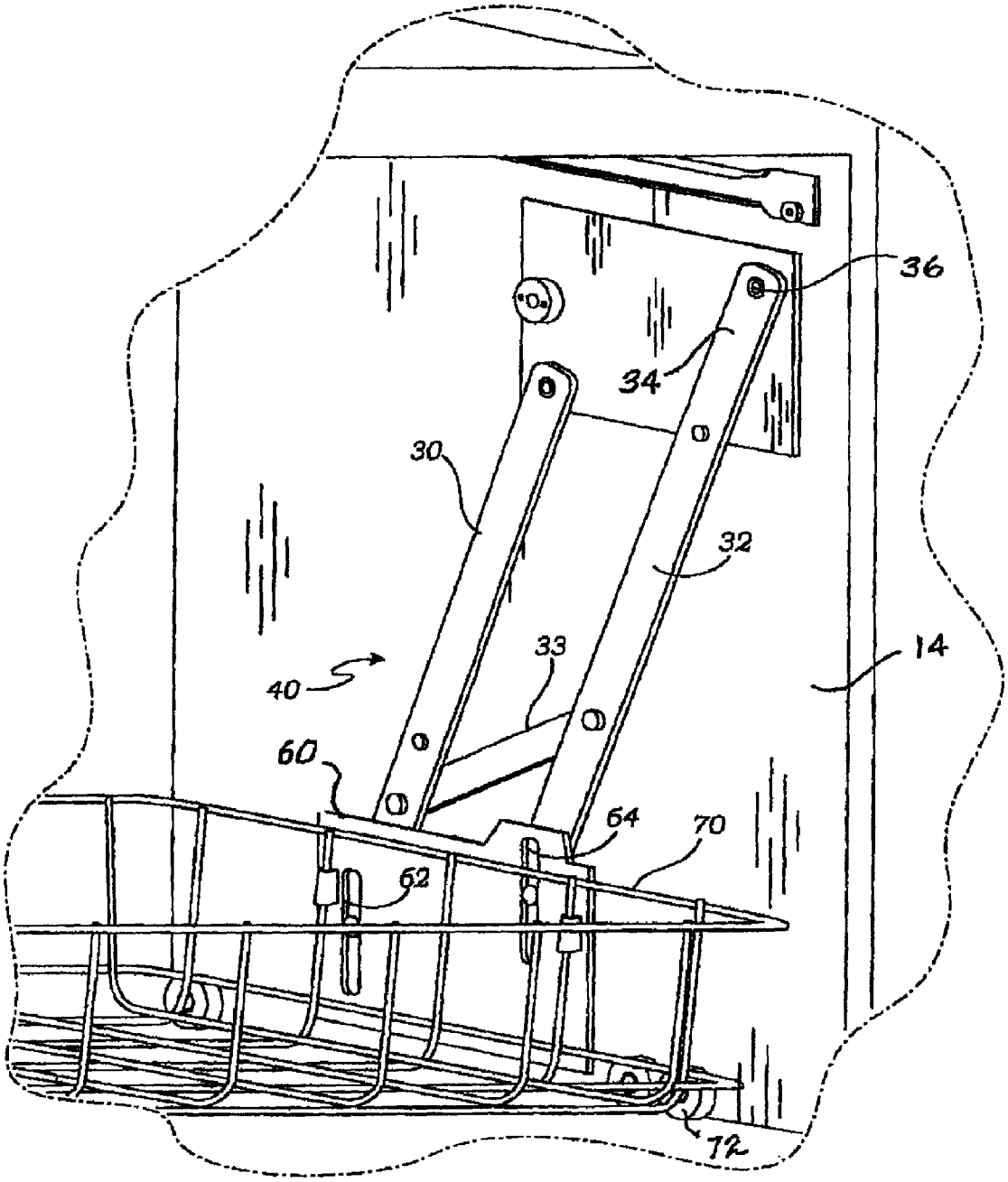
FIG. 3 is a partial enlarged view thereof, showing details of lifting arms of the invention.
Figure 7:
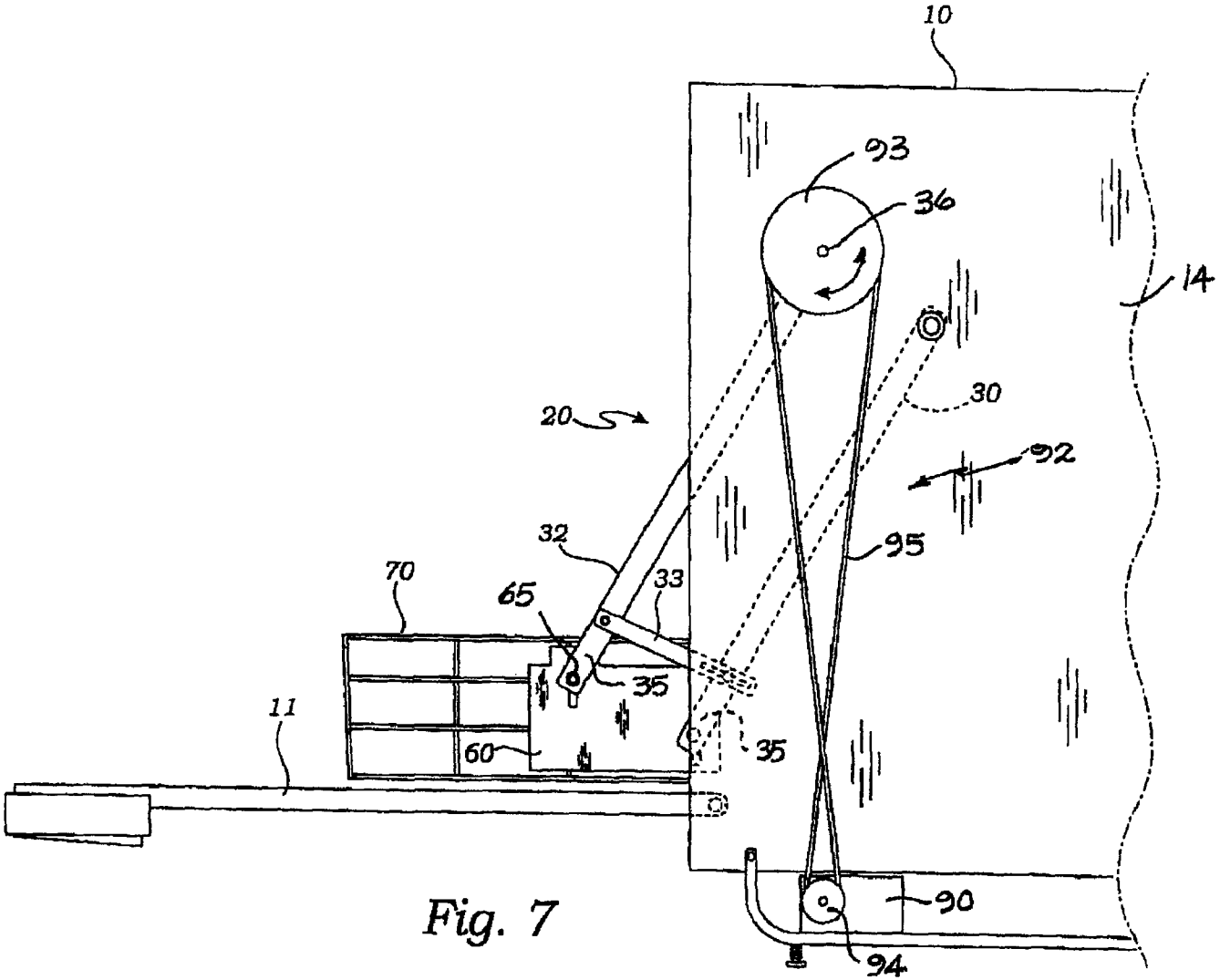

Preferably, in this embodiment, the motor 90 is positioned below a bottom panel of the dishwasher as shown in FIGS. 1 and 2 and drive shafts 91 join the motor 90 with the lower drive pulleys 94 which are positioned exterior to side walls 12 and 14. Preferably, cables 95' and 95" are mounted between pulleys 93 and 94 on each side of cabinet 10. These two cables 95' and 95", on each side are wound in opposite directions so that so that they act in a push-pull fashion, as one cable is winding, the other cable is unwinding. At any time in the retraction/lowering and extension/lifting of basket 70, only one of the two cables 95' and 95" is in tension, one (95') for driving the basket 70 out, as shown in FIG. 7, and then lifting it, as shown in FIG. 8; and one (95") for lowering the basket 70 and then driving it back into the cabinet 10. By using two cables 95' and 95", the need for more expensive and elaborate drive belts and pulleys is avoided, and the cables need not remain in constant tension. Also, the use of cables that reach their ends, thereby preventing further rotation, when the basket 70 has achieved its terminal positions, enables the motor 90 to be shut down at the end of each half cycle by a simple, cost saving, over-current sensor controlling a solid state relay or by a similar mechanism.

Figure 9:
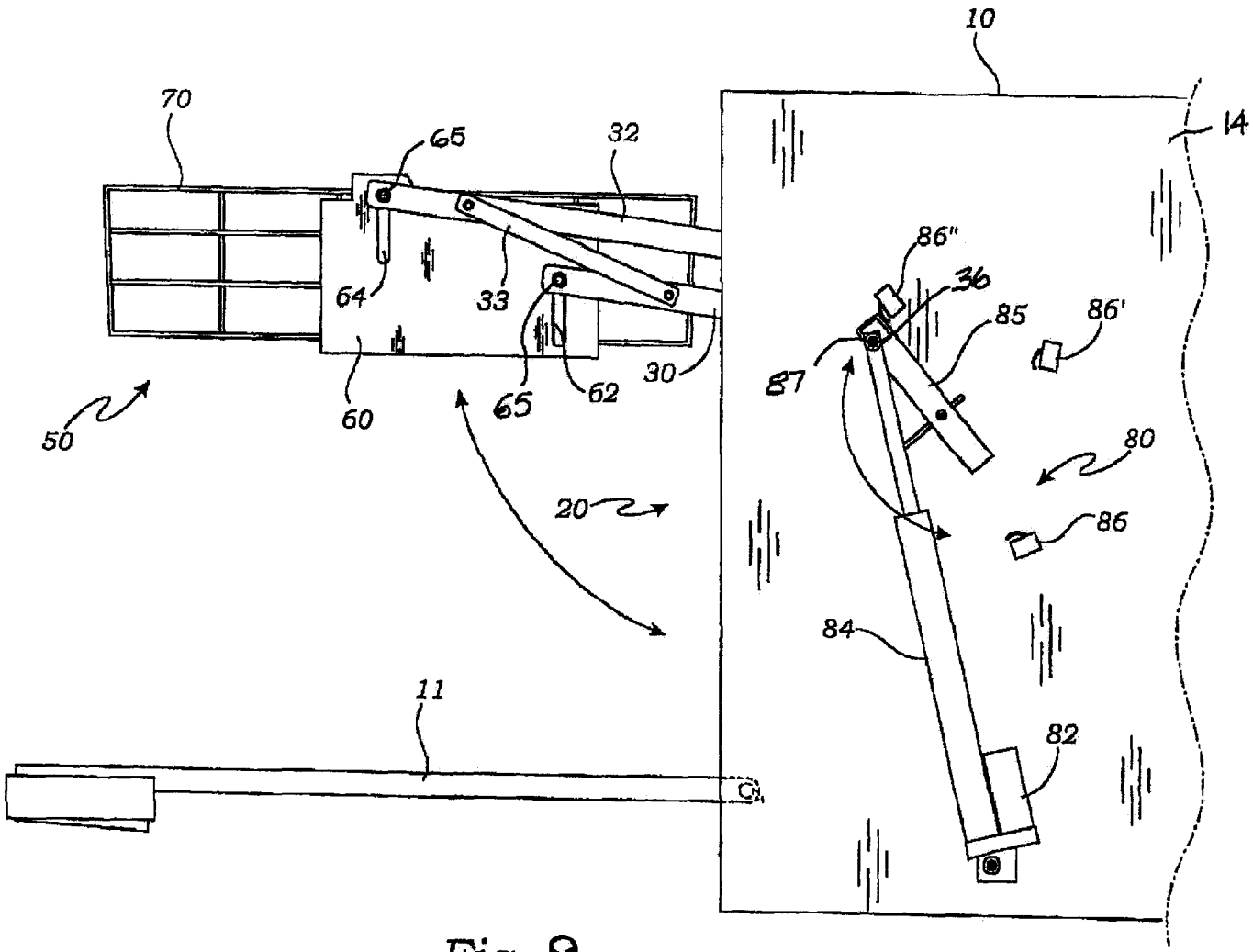
FIG. 9 is a side elevational view of an alternate lifting mechanism.

In an alternate embodiment, shown in FIG. 9, the electric drive system 80 is preferably a motor 82, such as a small electric gear-motor with a linearly extensible strut 84 such as a worm gear linear actuator, well known in the art. The drive system 80, preferably includes limit switches 86, 86' and 86" positioned for disengaging power to the drive system 80 when in position 40, as shown in FIG. 1, and in the extended 45 and raised position 50, as shown in FIGS. 3 and 9 respectively. The simple electrical circuit necessary for controlling the drive system 80 in this configuration would be configured easily by those of skill in the art and may, for instance, be adapted to move the arms 30 and 32 between positions 40 and 50 without stopping at position 45, or between positions 40 and 45 independently of moving between positions 45 and 50. Clearly, to enable such, limit switches 86, 86' and 86" are positioned for actuation when the drive system 80 has attained any one of the positions 40, 45 and 50 respectively. As shown in FIG. 9, leverage bar 85 is pivotally joined to extensible strut 84 at its distal end so as to provide torque leverage to pivot 87 interconnected with arm 32. The electric drive system 80 is configured in mirror image on both sides of cabinet 10 so that the opposing arms 32 on both sides are driven simultaneously for uniform motion actuation of basket 70.

In one embodiment illustrated in FIGS. 10-13, the drive pulley system 92 illustrated in FIGS. 2, 7, 8 is supplemented with an "extendible drive" portion, preferably a pair of springs, to enable the basket 70 to be manually moved from a rearward lowered position to a lowered forward position for access by user. In such an embodiment, the cables 95' and 95" may be referred to as the "rigid drive" portion to communicate a majority of the drive force from the motor 90 to the basket 70, while the extendible drive portion allows manual movement of the basket 70 between rearward lowered and forward lowered positions, as described below.

Figure 10:
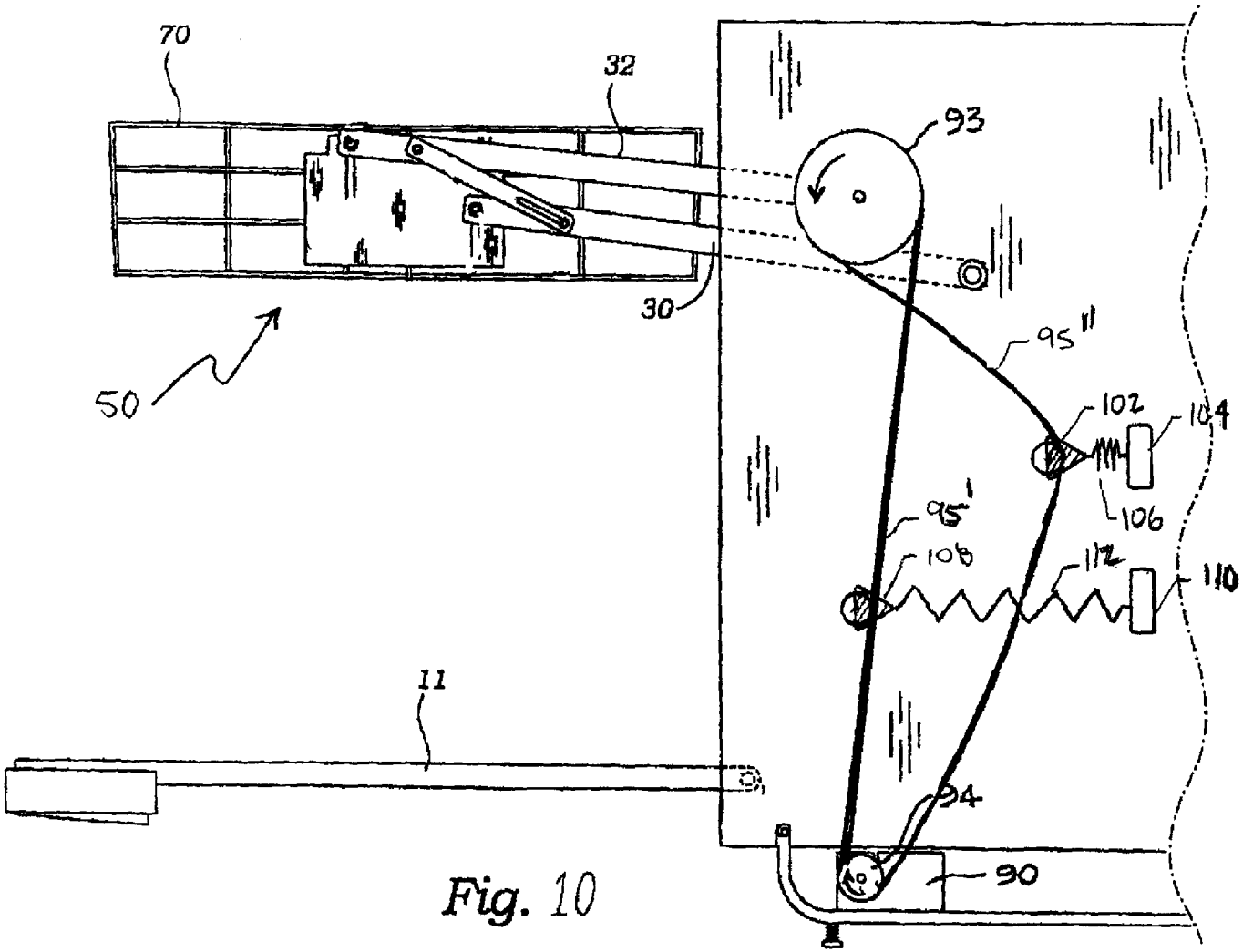
FIGS. 10-13 show a side elevation views of the basket illustrated in FIGS. 6-8, with springs introduced to the pulley drive lifting mechanism to enable manual actuation of the basket to the extended lowered position.

In FIG. 10, the arms 30, 32 are illustrated as having been moved from the rearward lowered position in the cabinet (See FIG. 6) to the forward directed raised position 50, with the motor 90 rotating in a first directional sense to drive the basket using force communicated by cable 95" extending between follower and drive pulleys 93 and 94, respectively. In this embodiment, cable 95'" extending between respective follower and drive pulleys 93 and 93 is seated in a spring pulley 102 connected to a first pulley anchor 104 through a first spring 106 to take up slack provided in the cable 95". Through the use of the spring pulley 102, cable 95' is slidably coupled to the first spring 106. Cable 95' is seated in a second pully anchor 108 connected to a second pully anchor 110 through a second spring 112 thus creating a slidable coupling between the cable 95' and second spring 112. In this position of the basket, cable 95' continues to carry the basket load and is substantially taut, with the second spring 112 fully extended. During retraction/lowering of basket 70, the cable 95" remains in tension, with the first spring 106 continuing to take up pre-existing slack in cable 95" as the basket 70 is lowered vertically in arcuate rotation to the lowered forward position illustrated in FIG. 11 by the motor 90 driving the pair of drive pulleys 94 in the opposite rotational sense.

Figure 11:
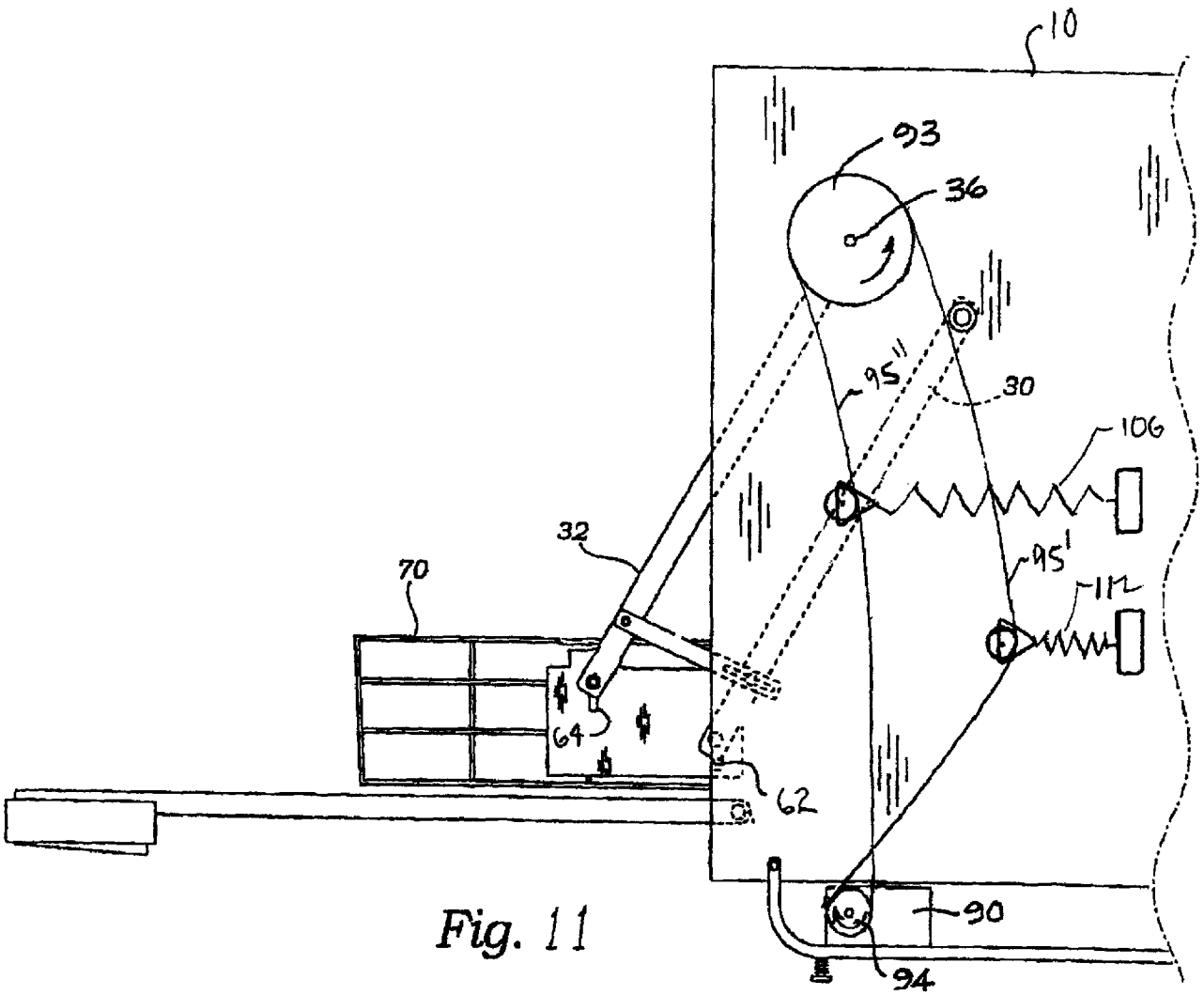

FIG. 11 illustrates the basket 70 positioned in the forward lowered position, with the drive pulley system transitioning to transmit rotational force from cable 95' to cable 95" to draw the basket into the cabinet 10. As the basket 70 is lowered to the forward lowered position, slack previously existing in cable 95" is wound up onto a respective drive pully 94 and a similar amount of slack is unwound for cable 95' to be taken up by second spring 112. As a substantial portion of the previous slack in cable 95" is removed and becomes taught between its respective follower and drive pulleys 93, 94, rotational motor force of motor 90 is transmitted through cable 95" to arms 30 and 32 through axels 36 so that arms 30 and 32 pivotally engage with the elongate closed slot 62 and 64 to pull the basket 70 rearward and horizontally from the illustrated forward/lowered position back to the rearward lowered position 113 illustrated in FIG. 12. As the basket is pulled into the cabinet 10 by rotational force transmitted by cable 95", slack in cable 95' created during the transition out of the forward lowered position continues to be taken up by the second spring 106.

Figure 12:
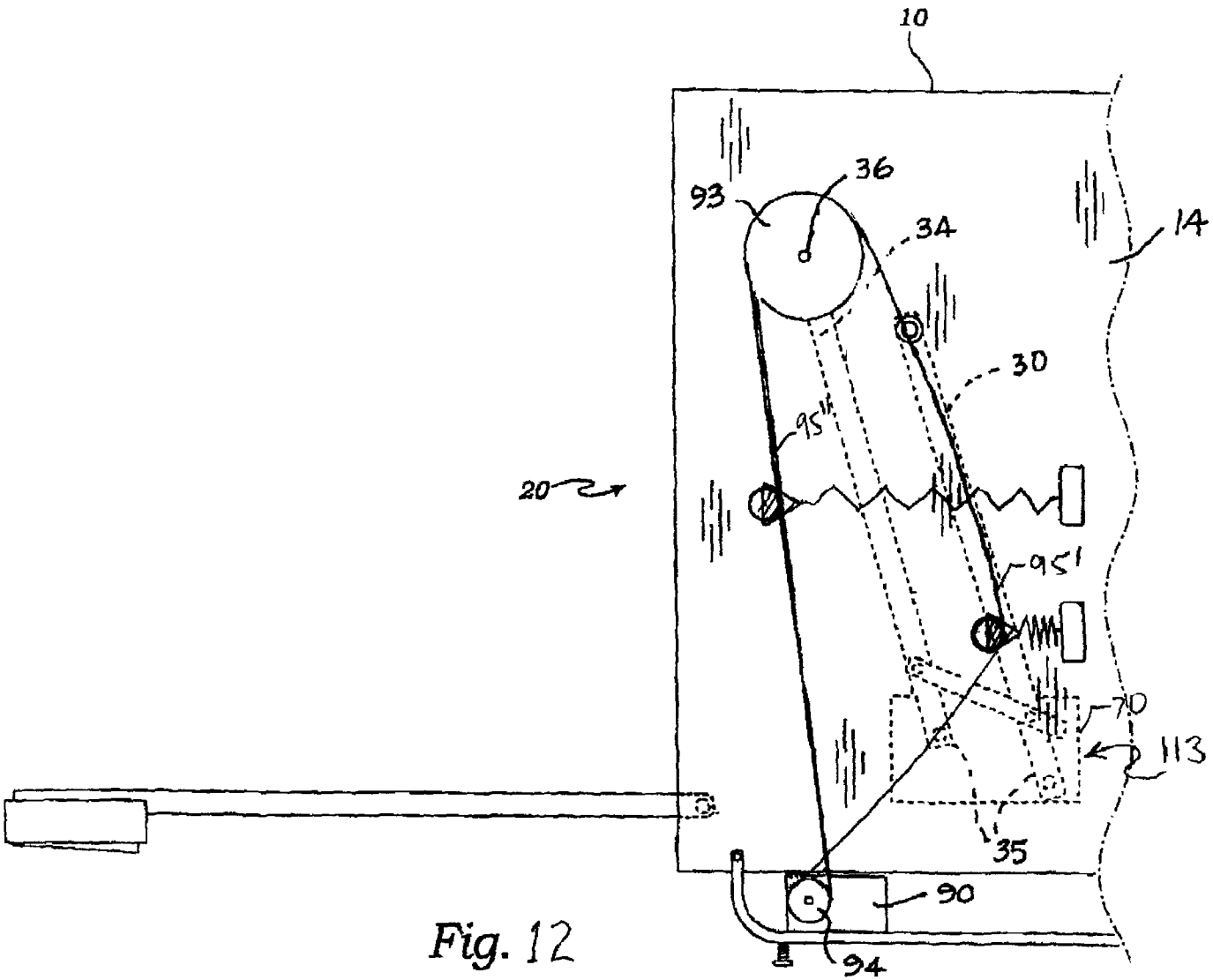
Figure 13:
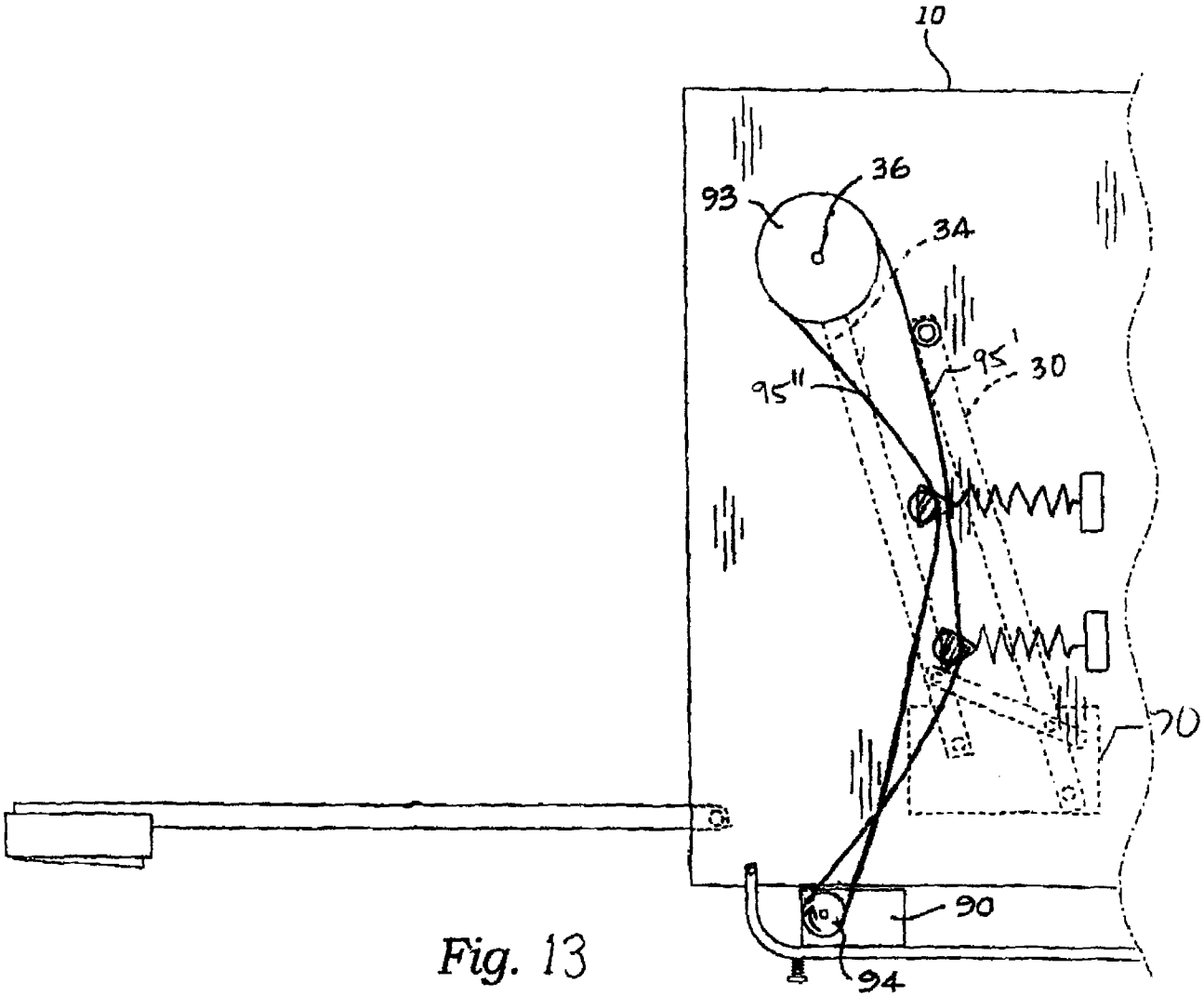

FIG. 12 illustrates the drive pulley system as the basket 70 reaches its rearward lowered position. As the basket 70 reaches the end of its travel at the rearward lowered position, the motor 90 is preferably stopped by an over-current sensor controlling a solid state relay in response to the cable 95' becoming taunt. Or, an over travel sensor (not illustrated) may be positioned adjacent the end of basket travel to indicate a stop condition to the motor 90. After the motor 90 is triggered to stop, the motor 90 preferably changes rotational direction to re-introduce slack into cable 95", with the same amount of slack in 95' being wound up on a respective drive pully 94. With slack re-introduced into cable 95" from the motor 90 briefly changing rotational direction, the basket 70 may be manually pulled forward to the forward/lowered position as illustrated in FIG. 11 by a user.

Although FIGS. 10-13 illustrate an extendible drive portion and rigid drive portion as springs and cables, respectively, the invention is not so limited. For example, the linearly extensible strut 84 illustrate in FIG. 9 may also be considered a rigid drive portion, with suitable extendible drive portions selected from a group such as springs, shocks or other elastic components. In such an alternative embodiment, an extendible drive portion may be provided between the linearly extensible strut 84 and leverage bar 85 or through another suitable configuration.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

We claim:

1. An apparatus, comprising:

a basket positioned in a cabinet;

a motor to drive the basket from a rearward lowered position in the cabinet to a forward directed raised position outside of the cabinet;

a driver connecting the basket to the motor, the driver comprising;

an extendable drive portion to allow manual movement of the basket from the rearward lowered position to a forward lowered position; and a rigid drive portion to transmit force from the motor to the basket to drive the basket between the rearward lowered position and the forward directed raised position;

wherein the basket may be pulled by a user from the rearward lowered position to the forward lowered position and the driver enables the motor to drive the basket to the forward directed raised position.

2. The apparatus of claim 1, further comprising at least one arm connected between the basket and the driver to move the basket between the rearward closed position and the forward raised position.

3. The apparatus of claim 2 further comprising;

a pair of drive pulleys connected between the motor and the driver to translate motor motion to drive motion; and a pair of follower pulleys connected between the driver and the basket to translate driver motion to basket motion through said at least one arm.

4. The apparatus of claim 3 wherein the substantially rigid portion of the driver comprises a pair of drive cables.

5. The apparatus of claim 4, wherein the extendible drive portion comprises a pair of springs slidably coupled to respective cables in the pair of cables, the pair of springs attached to a respective pair of spring anchors so that the pair of springs are operable to take up slack presented in each of the respective cables.

6. A method of enabling manual operation of a motor-driven basket, comprising driving a basket from a forward lowered position to a rearward lowered position in a cabinet using rotational force from a motor rotating in a first rotational sense, the rotational force transmitted to the basket through a first cable;

stepping back the motor to provide slack in the first cable to enable manual translation of the basket back to the forward lowered position; and taking up the slack using a first elastic member.

7. The method according to claim 6, further comprising:

manually pulling out the basket to the forward lowered position thereby taking up the slack in the cable.

8. The method according to claim 6, further comprising:

driving the basket into a forward raised position outside of the cabinet using rotational force from the motor rotating in a second rotational sense, the rotational force transmitted to said basket through a second cable.

9. The method according to claim 8, further comprising:

taking up slack in the second cable as the motor steps back to provide slack in the first cable.

10. According to claim 8, wherein the driving the basket into the forward raised position further includes taking up slack in the first cable using a second elastic member as the motor rotates in the second rotational sense.

* * * * *